US008325104B2

(12) United States Patent
Sim et al.

(10) Patent No.: US 8,325,104 B2
(45) Date of Patent: Dec. 4, 2012

(54) DIPOLE TAG ANTENNA STRUCTURE MOUNTABLE ON METALLIC OBJECTS USING ARTIFICIAL MAGNETIC CONDUCTOR FOR WIRELESS IDENTIFICATION AND WIRELESS IDENTIFICATION SYSTEM USING THE DIPOLE TAG ANTENNA STRUCTURE

(75) Inventors: Dong-Uk Sim, Daejeon (KR); Hyung-Do Choi, Daejeon (KR); Jong-Hwa Kwon, Daejeon (KR); Dong-Ho Kim, Daejeon (KR); Jae-Ick Choi, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 632 days.

(21) Appl. No.: 12/517,400

(22) PCT Filed: Oct. 31, 2007

(86) PCT No.: PCT/KR2007/005477

§ 371 (c)(1),
(2), (4) Date: Jun. 3, 2009

(87) PCT Pub. No.: WO2008/069459

PCT Pub. Date: Jun. 12, 2008

(65) Prior Publication Data

US 2010/0007569 A1 Jan. 14, 2010

(30) Foreign Application Priority Data

Dec. 4, 2006 (KR) ..... 10-2006-0121816
Feb. 27, 2007 (KR) ..... 10-2007-0019904

(51) Int. Cl.
*H01Q 15/02* (2006.01)

(52) U.S. Cl. ..... 343/909; 343/795

(58) Field of Classification Search ..... 235/492; 343/795, 909

See application file for complete search history.

(56) References Cited

U.S. PATENT DOCUMENTS 1,774,866 A 9/1930 Beadle
6,768,476 B2 7/2004 Lilly et al.

(Continued)

FOREIGN PATENT DOCUMENTS

JP 2003-298464 A 10/2003

(Continued)

OTHER PUBLICATIONS

Romulo F. Jimenez Broas, et al; "A High-Impedance Ground Plane Applied to a Cellphone Handset Geometry", IEEE Transactions on Microwave Theory and Techniques, vol. 49, No. 7, Jul. 2001, pp. 1262-1265.

(Continued)

*Primary Examiner* — Jacob Y Choi
*Assistant Examiner* — Kyana R McCain
(74) *Attorney, Agent, or Firm* — Ladas & Parry LLP

(57) ABSTRACT

Provided are a dipole tag antenna using an artificial magnetic conductor (AMC) for wireless identification and a wireless identification system using the dipole tag antenna. The dipole tag antenna includes: a substrate formed of a first dielectric material; a conductive ground layer formed underneath the substrate; an AMC layer formed on the substrate; the dipole tag antenna mounted on the AMC layer and comprising a wireless identification chip; and the AMC directly mounted on a conductor.

18 Claims, 5 Drawing Sheets

U.S. PATENT DOCUMENTS

| | | | | |
|---|---|---|---|---|
| 6,774,866 | B2 * | 8/2004 | McKinzie et al. | 343/909 |
| 6,906,674 | B2 | 6/2005 | McKinzie, III et al. | |
| 6,917,343 | B2 | 7/2005 | Sanchez et al. | |
| 7,023,386 | B2 * | 4/2006 | Habib et al. | 343/700 MS |
| 2003/0197658 | A1 | 10/2003 | Lilly et al. | |
| 2003/0231142 | A1 | 12/2003 | McKinzie, III et al. | |
| 2005/0200527 | A1 | 9/2005 | Habib et al. | |
| 2006/0017651 | A1 | 1/2006 | Werner et al. | |

FOREIGN PATENT DOCUMENTS

| | | | | |
|---|---|---|---|---|
| JP | 2003298464 | A | * | 10/2003 |
| JP | 2004-535722 | A | | 11/2004 |
| JP | 2005-167327 | A | | 6/2005 |
| JP | 2007-529946 | A | | 10/2007 |
| KR | 1020020027225 | A | | 4/2002 |
| WO | 03-007429 | A1 | | 1/2003 |
| WO | 2006/039699 | A2 | | 4/2006 |

OTHER PUBLICATIONS

Zhengwei Du, et al; "A Compact Planar Inverted-F Antenna With a PBG-Type Ground Plane for Mobile Communications", IEEE Transactions on Vehicular Technology, vol. 52, No. 3, May 2003, pp. 483-489.

Fan Yang, et al; "Reflection Phase Characterizations of the EBG Ground Plane for Low Profile Wire Antenna Applications", IEEE Transactions on Antennas and Propagation, vol. 51, No. 10, Oct. 2003, pp. 2691-2703.

International Search Report; mailed Feb. 4, 2008; PCT/KR2007/005477.

* cited by examiner

DIPOLE TAG ANTENNA STRUCTURE MOUNTABLE ON METALLIC OBJECTS USING ARTIFICIAL MAGNETIC CONDUCTOR FOR WIRELESS IDENTIFICATION AND WIRELESS IDENTIFICATION SYSTEM USING THE DIPOLE TAG ANTENNA STRUCTURE

TECHNICAL FIELD

This work was supported by the IT R&D program of MIC/IITA. [2005-S-047-02, Development of Material and Devices for EMI Suppression]

The present invention relates to an antenna and a wireless identification system using the antenna, and more particularly, to a dipole tag antenna using an artificial magnetic conductor (AMC) and a wireless identification system using the dipole tag antenna.

BACKGROUND ART

A magnetic conductor corresponds to a general electric conductor. A tangential component of an electric field is almost '0' on a surface of an electric conductor, while a tangential component of a magnetic field is almost '0' on a surface of a magnetic conductor. Thus, a current does not flow on the surface of a magnetic conductor differently from that of an electric conductor.

A magnetic conductor operates as a component which has a considerably high resistance in a specific frequency, i.e., performs a function of an open circuit, due to the characteristic of the magnetic conductor. A specific unit cell patterns may be periodically arrayed on the general electric conductor to realize the magnetic conductor. The magnetic conductor is referred to as an artificial magnetic conductor (AMC).

A surface of the AMC has a high impedance surface (HIS) characteristic in terms of the circuit as described above. The HIS characteristic depends on a specific frequency according to formed AMC patterns.

An antenna generally requires a distance of ¼ or more of a wavelength λ of a transmitted and received signal from a ground surface of the electric conductor. If the antenna is at a closer distance than λ/4, a surface current flowing in an opposite direction to a current flowing in the antenna is inducted to the ground surface of the electric conductor. Thus, the two currents are offset. As a result, the antenna cannot operate effectively. However, since a current does not flow on a surface of the AMC, the antenna operates much closer to the AMC than the electric conductor. As a result, a distance between the ground surface of the electric conductor and the antenna can be reduced.

Interest in tags mountable on conductors and tags usable on high dielectric materials such as water has increased in the field of the development of tag antennas of wireless identification systems such as radio frequency identification (RFID). General tag antennas that are mounted on conductors cannot operate as antennas. However, tag antennas using AMCs can be mounted on vehicles, container boxes, or the like to be sufficiently utilized, thus expanding the utilization of wireless identification systems.

FIGS. 1A and 1B are side and perspective views, respectively, of an AMC 10 applied to a conventional antenna.

Referring to FIG. 1A, the AMC 10 includes a ground layer 18, a first dielectric layer 14, an AMC layer 12, and a frequency selective surface (FSS) layer 22.

The AMC layer 12 is connected to the ground layer 18 through vias 16 formed of metal, and the FSS layer 22 is connected to the ground layer 26 and a power source to form a capacitor 24.

Referring to FIG. 1B, patterns of the AMC layer 12 are arrayed in simple square patches. The simple square patches are electrically connected to the ground layer 18 through the vias 16 formed of metal. A monopole type antenna (not shown) is mounted on the AMC layer 12, and the FSS layer 22 is capacitively loaded in order to reduce a length of the antenna.

The first dielectric layer 14 is formed at a distance of about 1/50 of a wavelength λ of a transmitted and received signal from the ground layer 18. A conventional antenna does not need a distance of ¼ or more of a wavelength of a transmitted and received signal from a ground layer due to an AMC.

A conventional antenna using an AMC as illustrated in FIGS. 1A and 1B includes vias for the AMC. Also, an antenna such as a monopole antenna is mounted on the AMC. The monopole antenna is supplied with power from a feeding port to operate. Accordingly, since a conventional antenna necessarily includes vias, the formation of an AMC is complicated. Also, since a conventional antenna includes a feeding port for supplying power, a structure of the conventional antenna is complicated, and the size of the conventional antenna is increased.

DISCLOSURE OF INVENTION

Technical Problem

The present invention provides a dipole tag antenna structure using an artificial magnetic conductor (AMC) for wireless identification and a wireless identification system using the dipole tag antenna structure. The dipole tag antenna structure can be mounted directly on a conductor, have a simple low-profile structure, reduce manufacturing costs, include a wireless identification chip, and does not require a feeding port.

Technical Solution

According to an aspect of the present invention, there is provided a dipole tag antenna structure using an AMC for a wireless identification, including: a substrate formed of a first dielectric material; a conductive ground layer formed underneath the substrate; an AMC layer formed on the substrate; the dipole tag antenna mounted on the AMC layer and comprising a wireless identification chip; and the AMC directly mounted on a conductor.

The dipole tag antenna structure may have a low-profile structure and thus easily be mounted directly on a conductor. The AMC layer may be formed in patterns in which unit cells having rectangular patch shapes are arrayed at predetermined distances. The AMC layer may include 8 unit cells having the rectangular patch shapes, wherein the 8 unit cells are disposed in a 4×2 matrix formation with a first distance between each of the rows and a second distance between each of the columns. A frequency characteristic and an identification distance of the dipole tag antenna may be changed according to variations of a length of a side of each of the unit cells.

The chip may operate by received electric waves. The dipole tag antenna may have a structure '~,' and the chip may be disposed in a center of the dipole tag antenna. The dipole tag antenna may further include two conductive plates which have rectangular shapes and openings, wherein the openings are respectively formed at sides of the two conductive plates, and the two conductive plates are connected to each other using a connector to form the structure in the shape of '~.' The connector may be inserted into the openings to be connected to the two conductive plates so as to form slots in the openings. A resonance frequency of the dipole tag antenna may be adjusted according to variations of lengths of sides of the two conductive plates and lengths and widths of the slots.

The dipole tag antenna structure may be mounted on the AMC layer at a distance of ¼ of an electromagnetic wavelength from the conductive ground layer. The substrate may be formed of epoxy.

According to another aspect of the present invention, there is provided a wireless identification system manufactured using the dipole tag antenna structure.

The AMC layer may include the unit cells which have the rectangular patch shapes and are arrayed at the predetermined distances The chip may operate by the electric waves and is disposed in the center of the dipole tag antenna, and the dipole tag antenna has the structure '~.'

A dipole tag antenna structure using an AMC according to the present invention may include a wireless identification chip which does not require a feeding port. Thus, the dipole tag antenna structure may operate as a tag antenna due to an electrical interaction between incident waves. Also, the dipole tag antenna may be mounted directly on a conductor including a vehicle or a container using the AMC having a low-profile structure. Thus, the dipole tag antenna structure may be applied to various wireless identification systems. The AMC may be manufactured in the low-profile structure without vias. Thus, the AMC may be manufactured at low cost, and a pattern of the AMC and a structure of the dipole tag antenna may be adjusted to considerably expand an identification distance of the dipole tag antenna structure.

Advantageous Effects

A dipole tag antenna structure using an AMC according to the present invention includes a chip for identifying wireless signal information and for supplying power. Also, the dipole tag antenna structure according to the present invention does not require a feeding port. The dipole tag antenna structure can be mounted directly on a conductor. In addition, the dipole tag antenna structure can be formed in a low-profile structure to be directly mounted on the conductor.

Moreover, the AMC can be formed so as not to include vias and thus can be easily manufactured. Also, patterns of an AMC layer and the dipole tag antenna can be formed in various shapes. In particular, the dipole tag antenna can be realized in a structure having the shape of '~,' and design parameters can be appropriately changed to appropriately adjust a frequency band and an identification distance of the dipole tag antenna.

Furthermore, the dipole tag antenna structure can be mounted directly on the conductor and thus easily mounted on various products including vehicles, containers, etc. so as to easily realize a wireless identification system. Consumers can be provided with various options with the expansion of applications of the wireless identification system.

DESCRIPTION OF DRAWINGS

The above and other features and advantages of the present invention will become more apparent by describing in detail exemplary embodiments thereof with reference to the attached drawings in which.

BEST MODE

Figure 1A:
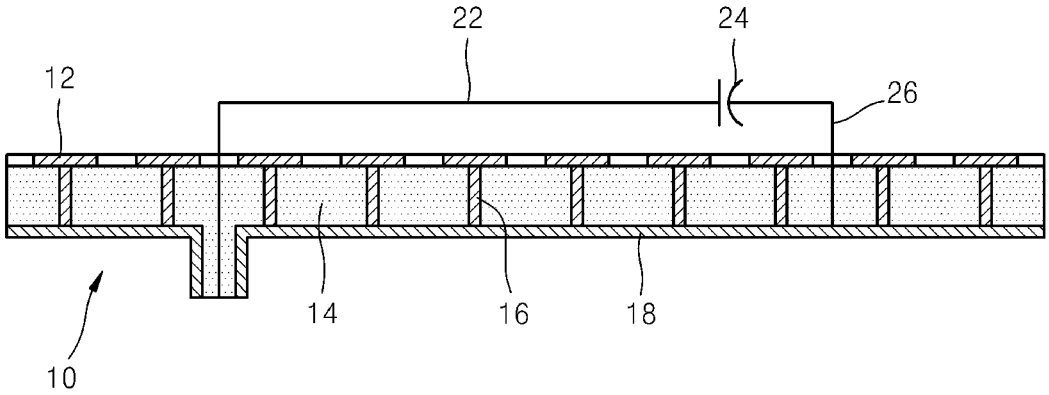
FIG. 1A (CONVENTIONAL ART)
FIGS. 1A and 1B are side and perspective views, respectively, of an artificial magnetic conductor (AMC) applied to a conventional antenna.
Figure 1B:
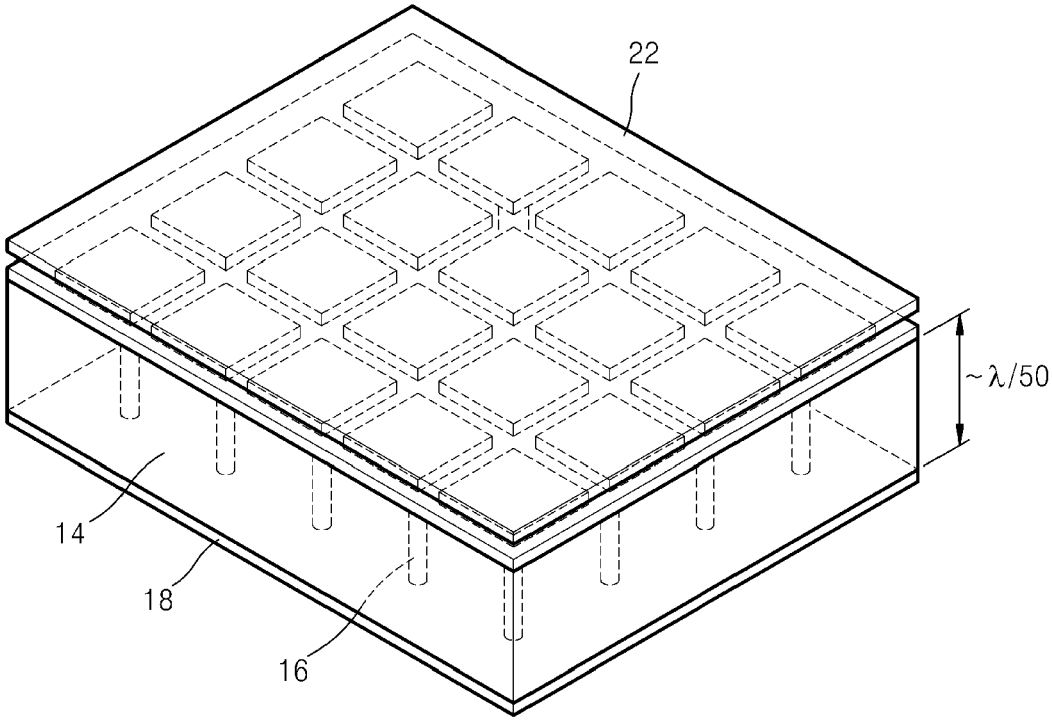
FIG. 1B (CONVENTIONAL ART)

The present invention will now be described more fully with reference to the accompanying drawings, in which exemplary embodiments of the invention are shown. The invention may, however, be embodied in many different forms and should not be construed as being limited to the embodiments set forth herein; rather, these embodiments are provided so that this disclosure will be thorough and complete, and will fully convey the concept of the invention to those skilled in the art. In the drawings, the thicknesses of layers and regions are exaggerated for clarity. It will also be understood that when a layer is referred to as being 'on' another layer or substrate, it can be directly on the other layer or substrate, or intervening layers may also be present. Like reference numerals in the drawings denote like elements, and thus their description will be omitted.

Figure 2:
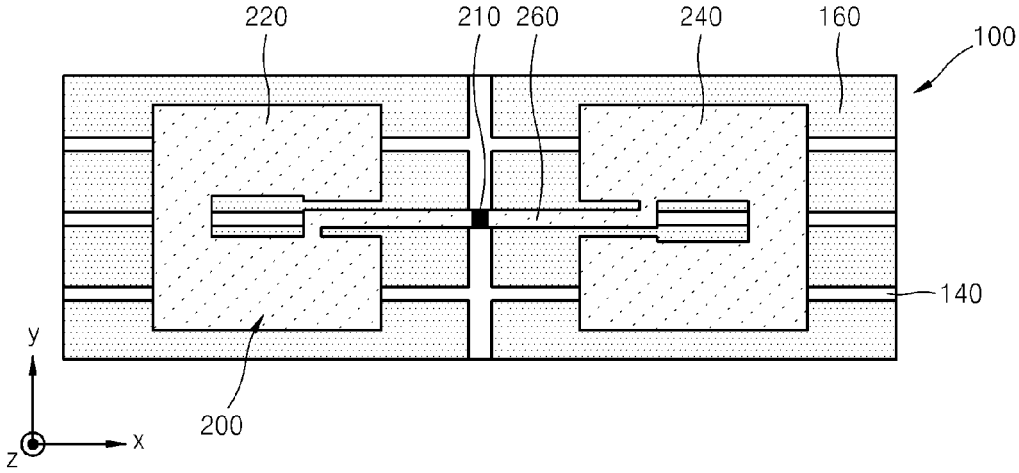
FIG. 2 is a plan view of a dipole tag antenna structure using an AMC, according to an embodiment of the present invention.

FIG. 2 is a plan view of a dipole tag antenna structure using an artificial magnetic conductor (AMC) 100, according to an embodiment of the present invention. Referring to FIG. 2, the dipole tag antenna structure includes the AMC 100 and a dipole tag antenna 200 mounted onto the AMC 100.

The AMC 100 includes a conductive ground layer (not shown), a substrate 140 formed of a first dielectric, and an AMC layer 160. The AMC layer 160 has predetermined patterns which are formed of a conductive material and arrayed. In the present embodiment, conductive plates having square patch shapes are arrayed at predetermined distances in an m×2 matrix formation. The AMC layer 160 is formed in a square patch shape in an m×2 matrix formation in the present embodiment, but patterns of the AMC layer 160 are not limited to this square patch shape.

The AMC 100 of the present embodiment does not require vias for connecting the AMC layer 160 to the conductive ground layer. Thus, the AMC 100 can be easily manufactured. However, the present invention is not limited thereto and the AMC 100 may include vias if necessary.

The dipole tag antenna 200 is disposed above the AMC layer 160. In other words, the dipole tag antenna 200 may be mounted on the AMC layer 160 but is generally mounted on a second dielectric layer (not shown) formed on the AMC layer 160. The second dielectric layer may be formed of foam having a similar dielectric constant to air.

The dipole tag antenna 200 has a structure in which two conductive plates 220 and 240 having a square patch shape with empty central portions are connected to each other using a connector 260. Thus, the dipole tag antenna 200 is formed to have a structure in the shape of '~.' A wireless identification chip 210, which does not require a feeding port, is disposed in the center of the connector 260. In other words, the wireless identification chip 210 operates using energy of electric waves incident onto the dipole tag antenna 200, and not energy supplied through a power source.

The connector 260 is connected to the conductive plates 220 and 240 to form slots between the connector 260 and the conductive plates 220, and 240 connected to form slots. Thus, a frequency characteristic of the dipole tag antenna 200 may vary depending on the size of the slots. Sizes of the conductive plates 220 and 240*m*, the connector 260, and the slots will be described later with reference to FIG. 3.

If an antenna structure is constituted using an AMC, an entire structure of the antenna may be formed in a low-profile shape. Also, since the dipole tag antenna does not require a distance of $\lambda/4$ or more from a ground surface of an electric conductor, the entire size of the antenna structure may be reduced. In addition, a reflection phase is slightly changed in a resonant frequency. Differently from an electric conductor, electric waves radiated from the antenna are reflected from the AMC in the same phase. Thus, a gain can be theoretically improved by about 3 dB compared to when the electric conductor is used. The antenna structure may be manufactured to have a low profile shape and thus is capable of being directly mounted on a metal conductor surface such as a vehicle, a container, or the like.

Figure 3:
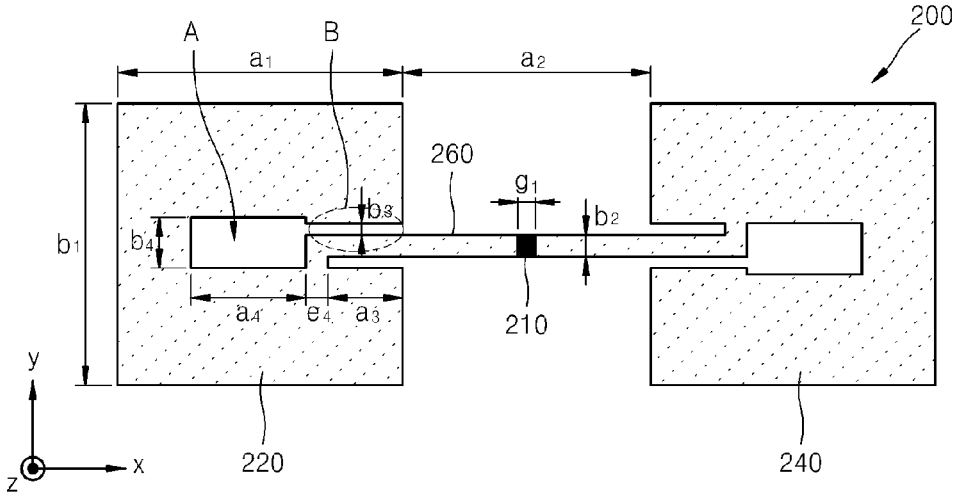
FIG. 3 is a detailed plan view of the dipole tag antenna of FIG. 2, according to an embodiment of the present invention.

FIG. 3 is a detailed plan view of the dipole tag antenna 200 of FIG. 2, according to an embodiment of the present invention. Referring to FIG. 3, the dipole tag antenna 200 of the present embodiment is mounted above the AMC layer 160 at a predetermined distance and is formed in the shape of '~.' The structure and design parameters of the dipole tag antenna 200 are illustrated in detail in FIG. 3.

The conductive plates 220 and 240 have large slots A in centers thereof, operate as arms of the dipole tag antenna 200, and are connected to each other via the connector 260. The connector 260 is connected to the conductive plate 240 through an upper portion of the large slot A formed in the conductive plate 240 and to the conductive plate 220 through a lower portion of the large slot A formed in the conductive plate 220. As a result, the dipole tag antenna 200 is formed in the shape of '~.' Small slots B may be formed in portions of the large slots A which are connected to the connector 260.

The design parameters of the dipole tag antenna 200 may be changed to adjust a frequency characteristic, an identification distance, or the like of the dipole tag antenna 200. For example, lengths and widths of each of the conductive plates 220 and 240, lengths of the dipole tag antenna 200, sizes of the large slots A, lengths and widths of the small slots B, etc. may be changed to adjust a resonance frequency of the dipole tag antenna 200. Detailed values of the design parameters are shown in Table 1 below, according to an embodiment of the present invention.

Figure 4A:
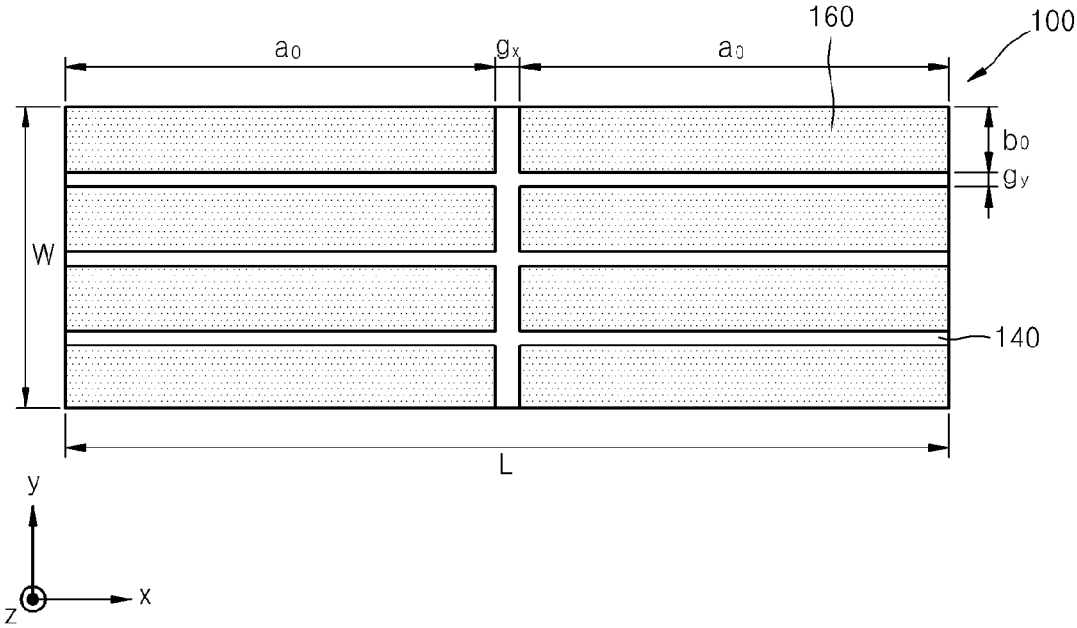
FIGS. 4A and 4B are plan views illustrating unit cell patterns of an AMC layer to be applied to the dipole tag antenna structure of FIG. 2, according to embodiments of the present invention.
Figure 4B:
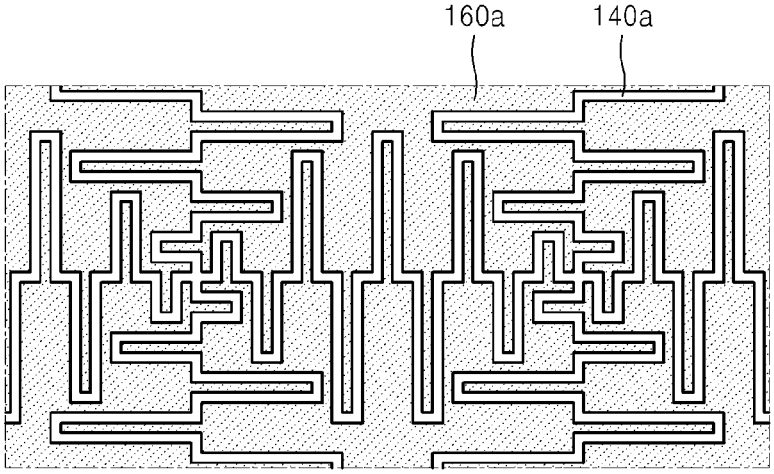

FIGS. 4A and 4B are plan views illustrating unit cell patterns of AMC layers 160 and 160*a* to be applied to the dipole tag antenna structure of FIG. 2, respectively, according to embodiments of the present invention Referring to FIG. 4A, the AMC layer 160 includes unit cells which are formed of a conductive material and arrayed on the substrate 140 formed of the first dielectric layer at predetermined distances. In more detail, the AMC layer 160 is constituted in a rectangular patch shape so that horizontal lengths of the unit cells are longer than vertical widths of the unit cells. According to the current embodiment of the present invention the AMC layer 160 has a structure in which the unit cells are arrayed at the predetermined distances in an m×2 matrix formation. Gaps between unit cells in each row are maintained as first gaps $g_y$, and gaps between unit cells in the columns are maintained as second gaps $g_x$.

In the present embodiment, the unit cells of the AMC layer 160 are arrayed in the rectangular patch shapes in an m×2 matrix formation. However, the present invention is not limited thereto, and shapes and array patterns of the unit cells of the AMC layer 160 may be modified into various forms according to the characteristic of the dipole tag antenna 200.

In other words, sizes or shapes of the unit cells of the AMC layer 160 or the gaps between the unit cells may be modified to change a reflection phase of the AMC layer 160. As a result, the frequency characteristic of the dipole tag antenna 200 may be adjusted. For example, considering a frequency characteristic of the dipole tag antenna 200 mounted on the AMC layer 160 during the design of the AMC layer 160, lengths $a_0$ of the unit cells of the AMC layer 160 and the gaps $g_x$ and $g_y$ between the unit cells may be adjusted to optimize the AMC layer 160.

FIG. 4B is a plan view illustrating unit cells of an AMC layer 160*a* to be applied to the dipole tag antenna structure of FIG. 2, according to another embodiment of the present invention. Referring to FIG. 4B, the unit cells of the AMC layer 160*a* may be shaped differently to the rectangular path shapes of FIG. 4A. The unit cells of the AMC layer 160*a* have structures in which a dielectric layer 140*a* having a specific regular shape i.e., an interdigital dielectric layer 140*a*, is formed in the AMC layer 160*a* having a square patch shape.

If the unit cells of the AMC layer 160*a* are formed in the above-described structures, the AMC layer 160*a* may be realized to have a smaller size than the AMC layer 160 of FIG. 4A. As a result, the entire size of the dipole tag antenna structure can be reduced. Also, the shape of the dielectric layer 140*a* formed on the AMC layer 160*a* may be changed to change the frequency characteristic of the dipole tag antenna 200. The dielectric layer 140*a* may be formed of the same or different dielectric material of which the substrate 140 is formed.

Figure 5:
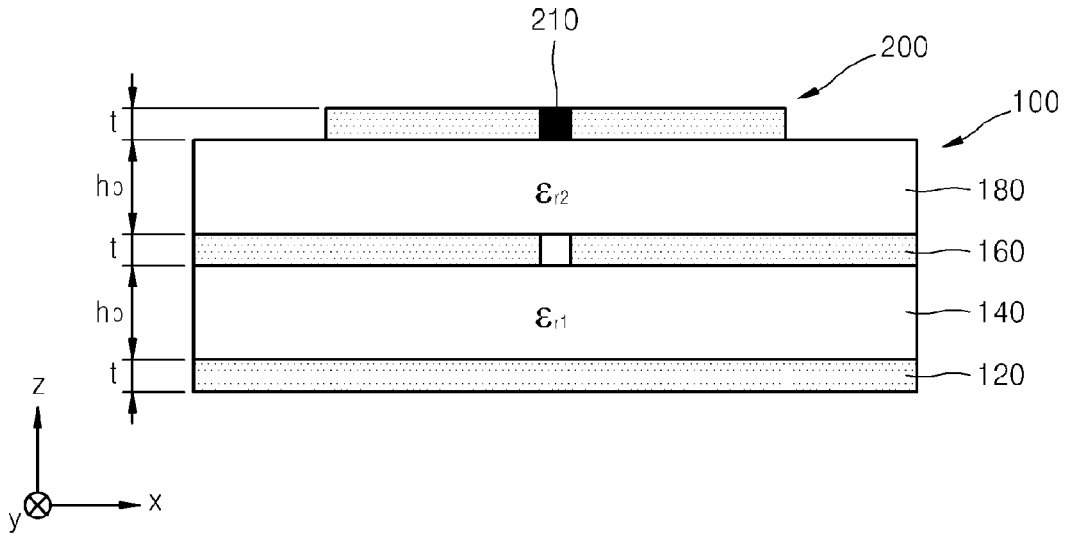
FIG. 5 is a side view of the dipole tag antenna structure of FIG. 2, according to an embodiment of the present invention.

FIG. 5 is a side view of the dipole tag antenna structure of FIG. 2 including the AMC 100, according to an embodiment of the present invention. Here, the AMC 100 includes the substrate 140 having a first dielectric constant $\in_{r1}$, a conductive ground layer 120 formed underneath the substrate 140, the AMC layer 160 formed on the substrate 140, and a second dielectric layer 180 formed on the AMC layer 160 and having a second dielectric constant $\in_{r2}$.

The substrate 140 may be formed of glass epoxy (FR4), and the AMC layer 160 may be formed in predetermined patterns as illustrated in FIG. 4A or 4B, but the present invention is not limited thereto. A dielectric material having the first dielectric constant $\in_{r1}$ of the substrate 140 may be filled among the unit cells of the AMC 160, but the present invention is not limited thereto and a dielectric material having a different dielectric constant from the first dielectric constant $\in_{r1}$ may be filled among the unit cells of the AMC layer 160.

The dipole tag antenna 200 includes the wireless identification chip 210 which does not need a feeding port. Also, the dipole tag antenna 200 may be formed in a low-profile shape having a structure in the shape of '~,' but the present invention is not limited thereto. The second dielectric layer 180 may be formed of a dielectric material such as foam having a low dielectric constant. If the AMC 100 is optimal, the second dielectric layer 180 may be omitted.

The thickness of the AMC 100 or the dipole tag antenna 200, dielectric constants of dielectric layers, etc. are design parameters for determining the frequency characteristic of the dipole tag antenna 200. Thus, thicknesses of layers, dielectric constants of dielectric layers, etc. constituting the AMC 100 may be appropriately adjusted in consideration of the entire size and frequency characteristic of the dipole tag antenna 200. Here, the dipole tag antenna 200 and pattern of the AMC layer 160 may be formed of a conductive material, e.g., a metal conductor.

The AMC 100 of the present embodiment may be formed in a low-profile structure which does not include vias formed between the square patch pattern of the AMC layer 160 and ground. Thus, the AMC 100 can be easily manufactured at low cost.

Table 1 below shows the design parameters and corresponding values of the dipole tag antenna structure, according to an embodiment of the present invention.

TABLE 1

| Parameter | Value (mm) |
|---|---|
| $a_0$ | 75 |
| $b_0$ | 10 |
| $a_1$ | 40 |
| $b_1$ | 42 |
| $a_2$ | 17 |
| $a_3$ | 10 |
| $a_4$ | 20 |
| $b_2$ | 2.5 |
| $b_3$ | 0.5 |
| $b_4$ | 4 |
| $e_4$ | 2.5 |
| $g_1$ | 1 |
| $g_x$ | 2 |
| $g_y$ | 2 |
| $h_0$ | 2 |
| t | 0.015 |
| $t_0$ | 1 |
| $\epsilon_{r1}$ | 4.5(FR4) |
| $\epsilon_{r2}$ | ≈1(Foam) |
| W | 46 |
| L | 152 |

The values of the design parameters in Table 1 are suitable for operating the dipole tag antenna 200 in a frequency band between 902 MHz and 928 MHz. In the present embodiment, the substrate 140 is formed of FR4, and the entire structure of the AMC 100 is manufactured to have a low-profile. Thus, manufacturing cost can be reduced when realizing a dipole tag antenna.

Figure 6:
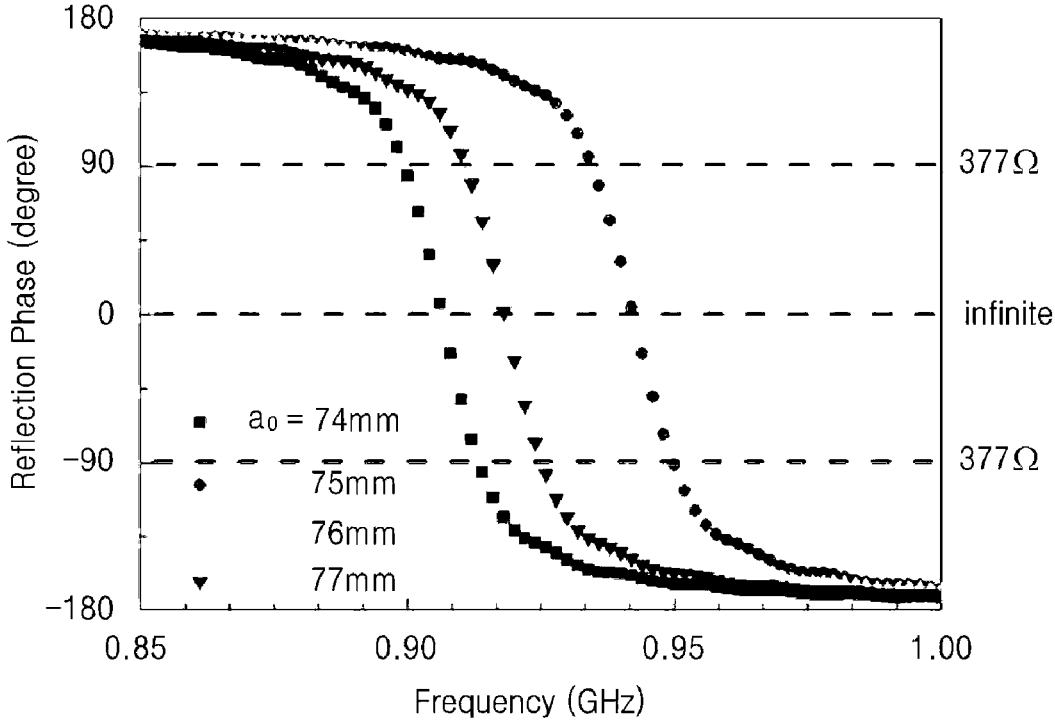
FIG. 6 is a graph illustrating a frequency characteristic of the dipole tag antenna of FIG. 2 with respect to variations of a length of a side of the unit cell of the AMC, according to an embodiment of the present invention.

FIG. 6 is a graph illustrating the frequency characteristic of the dipole tag antenna 200 of FIG. 2, i.e., a reflection phase characteristic, with respect to variations of a length of a side of each of the unit cells of the AMC 100, according to an embodiment of the present invention.

Referring to FIG. 6, a reflection phase of the AMC 100 is changed into a range between −90° and 90° in a frequency band between 0.9 GHz and 0.95 GHz. Such a reflection phase change section corresponds to a frequency band of the dipole tag antenna 200. The reflection phase change section between −90° and 90° is a section corresponding to a resistance value of the AMC 100 between 377Ω and infinitity. Here, the resistance value of 377Ω is known as Free Space Impedance (FSI). The AMC 100 may have an infinite resistance value and a reflection phase change of '0' in terms of gain of the dipole tag antenna 200.

The frequency band of the dipole tag antenna 200 is changed according to variations of a length of a side $a_0$ of each of the unit cells of the AMC 100 of FIG. 4A. In other words, the frequency band is lowered with an increase of the side $a_0$ of each of the unit cells. Also, although not shown, the shapes of the unit cells of the AMC 100 may be formed as illustrated in FIG. 4B to adjust the frequency band or reduce the entire size of the dipole tag antenna structure.

Figure 7:
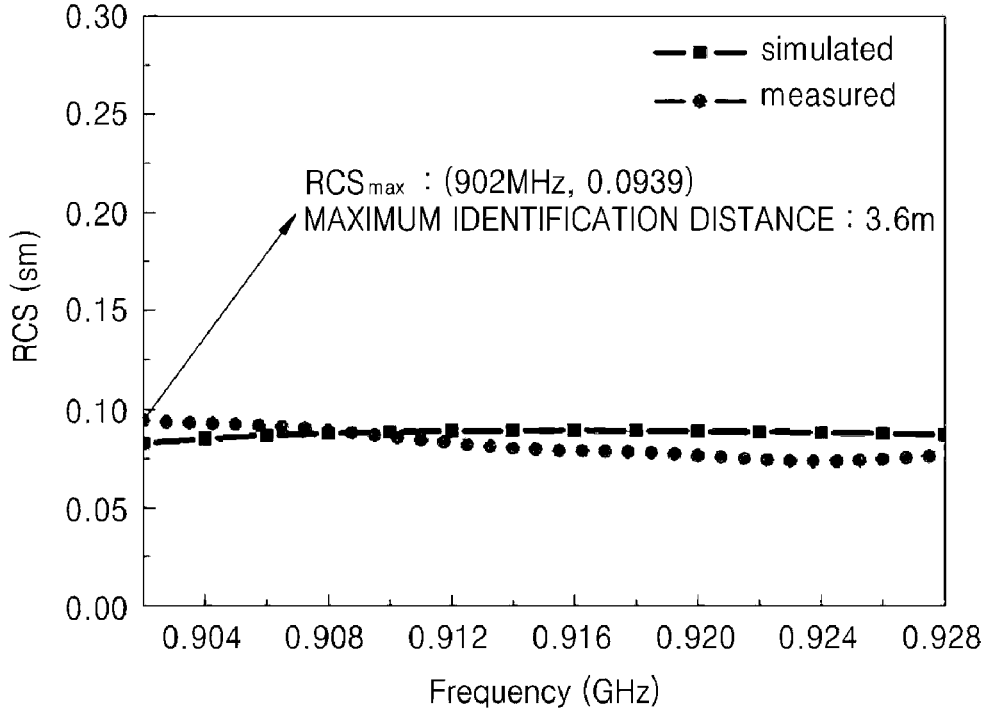
FIG. 7 is a graph illustrating a relationship between a radar cross section (RCS) and a maximum identification distance of the dipole tag antenna of FIG. 2, according to an embodiment of the present invention.

FIG. 7 is a graph illustrating a relationship between a radar cross section (RCS) and a maximum recognition distance of the dipole tag antenna 200 of FIG. 2, according to an embodiment of the present invention.

Referring to FIG. 7, the dipole tag antenna 200 of FIG. 2 has a maximum identification distance of 3.6 m in a frequency band of 902 MHz. A simulated value is almost similar to an experimentally measured value, and a RCS is stable.

A dipole tag antenna according to the present invention does not need to maintain a distance of λ/4 or more from a ground surface of an electric conductor using an AMC. Also, the AMC does not need to include vias. Thus, the dipole tag antenna structure according to the present invention can be easily manufactured. The dipole tag antenna structure can include a wireless identification chip and thus does not require a feeding port. The dipole tag antenna structure can be entirely formed in a low-profile structure and thus can be easily mounted on a vehicle, a container, or the like including a metallic conductor. As a result, a wireless identification system such as a radio frequency identification (RFID) system can be easily realized. Moreover, pattern shapes of an AMC layer of the AMC or a shape of the dipole tag antenna, e.g., design parameters of the dipole tag antenna having a structure in the shape of '~,' can be adjusted to adjust a frequency band and a maximum identification distance of the dipole tag antenna.

As described above, a dipole tag antenna structure using an AMC according to the present invention includes a chip for identifying wireless signal information and for supplying power. Also, the dipole tag antenna structure according to the present invention does not require a feeding port. The dipole tag antenna structure can be mounted directly on a conductor. In addition, the dipole tag antenna structure can be formed in a low-profile structure to be directly mounted on the conductor.

Moreover, the AMC can be formed so as not to include vias and thus can be easily manufactured. Also, patterns of an AMC layer and the dipole tag antenna can be formed in various shapes. In particular, the dipole tag antenna can be realized in a structure having the shape of '~,' and design parameters can be appropriately changed to appropriately adjust a frequency band and an identification distance of the dipole tag antenna.

Furthermore, the dipole tag antenna structure can be mounted directly on the conductor and thus easily mounted on various products including vehicles, containers, etc. so as to easily realize a wireless identification system. Consumers can be provided with various options with the expansion of applications of the wireless identification system.

While the present invention has been particularly shown and described with reference to exemplary embodiments thereof, it will be understood by those of ordinary skill in the art that various changes in form and details may be made therein without departing from the spirit and scope of the present invention as defined by the following claims.

MODE FOR INVENTION

Industrial Applicability

The present invention relates to an antenna and a wireless identification system using the antenna, and more particularly, to a dipole tag antenna using an artificial magnetic conductor (AMC) and a wireless identification system using the dipole tag antenna. The dipole tag antenna structure using an AMC according to the present invention includes a chip for identifying wireless signal information and for supplying power. Also, the dipole tag antenna structure according to the present invention does not require a feeding port. The dipole tag antenna structure can be mounted directly on a conductor. In addition, the dipole tag antenna structure can be formed in a low-profile structure to be directly mounted on the conductor.

The invention claimed is:

1. A dipole tag antenna structure directly mounted on a conductor using an AMC (artificial magnetic conductor) for wireless identification, comprising:

a substrate formed of a first dielectric material;

a conductive ground layer formed underneath the substrate;

an AMC layer formed on the substrate; and the dipole tag antenna mounted on the AMC layer and comprising a wireless identification chip, wherein the substrate formed of the first dielectric material does not include vias connecting the AMC layer to the conductive ground layer.

2. The dipole tag antenna structure of claim 1, wherein the dipole tag antenna structure has a low-profile structure.

3. The dipole tag antenna structure of claim 1, wherein the AMC layer is formed in patterns in which unit cells having rectangular patch shapes are arrayed at predetermined distances.

4. The dipole tag antenna structure of claim 3, wherein the AMC layer comprises 8 unit cells having the rectangular patch shapes, wherein the 8 unit cells are disposed in a 4×2 matrix formation with a first distance between each of the rows and a second distance between each of the columns.

5. The dipole tag antenna structure of claim 3, wherein a frequency characteristic and an identification distance of the dipole tag antenna are changed according to variations of a length of a side of each of the unit cells.

6. The dipole tag antenna structure of claim 3, wherein the wireless identification chip operates by receiving electrical waves.

7. The dipole tag antenna structure of claim 6, wherein the dipole tag antenna has a structure in the shape of "~," and the wireless identification chip is disposed in a center of the dipole tag antenna.

8. The dipole tag antenna structure of claim 7, wherein the dipole tag antenna comprises two conductive plates which have rectangular shapes and openings, wherein the openings are respectively formed at sides of the two conductive plates to face each other, and the two conductive plates are connected to each other using a connector to form the structure in the shape of "~."

9. The dipole tag antenna structure of claim 8, wherein the connector is inserted into the openings to be connected to the two conductive plates so as to form slots in the openings.

10. The dipole tag antenna structure of claim 9, wherein a resonance frequency of the dipole tag antenna is adjusted according to variations of lengths of sides of the two conductive plates and lengths and widths of the slots.

11. The dipole tag antenna structure of claim 1, wherein the dipole tag antenna is mounted on the AMC layer at a distance ¼ or less of an electromagnetic wavelength from the conductive ground layer.

12. The dipole tag antenna structure of claim 1, wherein the substrate is formed of epoxy.

13. A wireless identification system manufactured using the dipole tag antenna structure of claim 1.

14. The wireless identification system of claim 13, wherein the dipole tag antenna structure has a low-profile structure.

15. The wireless identification system of claim 13, wherein the AMC layer comprises the unit cells which have the rectangular patch shapes and are arrayed at the predetermined distances.

16. The wireless identification system of claim 13, wherein the wireless identification chip operates by receiving the electric waves and is disposed in the center of the dipole tag antenna, and the dipole tag antenna has a structure in the shape of "~."

17. The wireless identification system of claim 13, wherein the wireless identification system is an (RFID) radio frequency identification system.

18. The dipole tag antenna structure of claim 1, wherein the dipole tag antenna is mounted directly on the AMC layer.

* * * * *